United States Patent [19]

Legate et al.

[11] 4,187,709

[45] Feb. 12, 1980

[54] EXPLOSIVE FORMING

[75] Inventors: Roland A. Legate, Hitchin, England; Kevin Strickland, 28 Hazel Grove, Stotfold, Hitchin, Hertfordshire, England

[73] Assignee: Kevin Strickland, Hitchin, England

[21] Appl. No.: 871,836

[22] Filed: Jan. 24, 1978

Related U.S. Application Data

[62] Division of Ser. No. 716,564, Aug. 23, 1976, abandoned.

[51] Int. Cl.[2] ..... B21D 26/02

[52] U.S. Cl. ..... 72/56; 72/62

[58] Field of Search ..... 72/56–62

[56] References Cited

U.S. PATENT DOCUMENTS

| | | | |
|---|---|---|---|
| 3,358,487 | 12/1967 | Brejcha et al. | 72/56 |
| 3,376,633 | 4/1968 | Wesley | 72/56 |
| 3,555,866 | 1/1971 | Roth | 72/56 |

FOREIGN PATENT DOCUMENTS

| | | | |
|---|---|---|---|
| 2104771 | 2/1970 | Fed. Rep. of Germany | 148/12 B |

OTHER PUBLICATIONS

"Advanced High Energy Rate Forming", pp. 3, 4, 6, 7 of Sec. I and pp. 1–5215 of Sec. II.

*Primary Examiner*—Leon Gilden
*Attorney, Agent, or Firm*—Bacon & Thomas

[57] ABSTRACT

A hollow spherical article having at least two substantially diametrically opposed apertures in the spherical surface, said article being of wrought metal and having been moulded by explosive forming. The article may further comprise at least two cylindrical portions, said portions being located on the spherical surface and defining said apertures. The method of forming the hollow spherical article comprises placing a tube of wrought metal into a die, positioning a plurality of explosive charges within the tube and detonating the explosive charges to expand the tube to form said hollow spherical article having two cylindrical portions which may subsequently be removed by machining.

4 Claims, 6 Drawing Figures

EXPLOSIVE FORMING

This is a division of application Ser. No. 716,564, filed Aug. 23, 1976, and now abandoned.

BACKGROUND OF THE INVENTION

1. Field of the Invention

This invention relates to explosive forming and in particular to the manufacture of spherical or part-spherical objects by explosive forming. The present invention may be used, in a preferred embodiment, for the manufacture of ball valve internal spheres and outer casings.

2. Description of the Prior Art

In the various engineering fields where pipelines are used to transport material, the use of valves to control or shut off the flow is common.

One type of valve, which is commonly used is a ball valve which functions by allowing the material being transported to flow through a bore in its internal sphere or ball, when the internal sphere is rotated the flow of material is cut off or reduced. This internal sphere is the most important part of the valve as it has to be accurate with regard to spherical shape and surface finish, in order to function normally.

In view of this requirement all internal spheres are manufactured either as a casting, or as a drop forging, which is then subsequently machined to the close tolerances required. As there is also a requirement for pressure and structural ability, the castings are thick and thus large and heavy. This also applies to the outer casing of the ball valve.

One specific disadvantage of the existing system is that, should any casting or forging defect exist within the thickness of the sphere, this only becomes evident during the machining operation. Often the machining operation can be in its final stages when the defect becomes apparent, resulting in the scrapping of the sphere and the loss of the machining and labour time involved. The loss factor is estimated to be high, that is, approximately 15% of production. In addition, due to the weight of the casting or drop forging, the weight of the total valve assembly is quite high, this requiring additional support systems to the structural steelwork carrying the pipeline and valve assemblies.

SUMMARY OF THE INVENTION

According to the present invention there is provided a hollow, spherical article having at least two substantially diametrically opposed apertures in the spherical surface, said article being of wrought metal and having been moulded by explosive forming.

DESCRIPTION OF THE PREFERRED EMBODIMENTS

The hollow sphere may have at least two cylindrical portions attached to the surface and defining the apertures. A sphere having such cylindrical portions may be used on an outer casing for a ball valve. An internal sphere or ball for a ball valve may be produced by removing, for example by machining off, the cylindrical portions.

Wrought stainless steel is a suitable material from which the spherical article may be formed. Titanium, cupranickel, copper and Inconel are also suitable materials for use in the present invention. The article is generally formed from an extruded tube of suitable internal and external diameters.

Wrought material has greater strength capabilities in ratio to wall thickness than cast or forged materials. The use of wrought material in forming a sphere, for use in a ball valve has the following advantages:

1. Reduction in wall thickness of the sphere to a considerable degree, thus reducing the weight of the total valve, which, in turn, could reduce the requirement for a structural support system.

2. The reduction in weight could also mean advantageous re-designing of turning and operating apparatus.

3. Since porosity is not present in wrought material (e.g. in the form of sheet, strip, tube) the loss rate of 15% would be reduced considerably or eliminated.

The present invention also provides a method of making a hollow spherical article as described above, said method comprising placing a tube of wrought metal in a die, positioning a plurality of explosive charges within the tube and detonating the explosive charges to expand the tube into said hollow spherical article having two cylindrical portions located on the surface of said article, said cylindrical portions defining said substantially diametrically opposed apertures in said spherical surface.

The tube so formed generally has two cylindrical portions attached to the hollow sphere, which cylindrical portions have the same dimensions as the original tube. The method may also comprise the further step of removing the cylindrical portions.

The explosive charges may be a series of single charges which are detonated in sequence. Any commercially available high explosive may be used as the source of the shock wave which expands the tube into a spherical shape. Preferably P.E.T.N. (pentaerythritol tetranitrate) is used as the explosive although any explosive which produces comparable energy and detonation velocity in a confined space may be used.

Between the firings the tube being formed may be removed from the die and annealed in order to soften the material of the tube which tends to harden as a result of the explosive forming. Annealing need not take place after each firing. Annealing is particularly useful when stainless steel is used since this has a tendency to harden rather quickly. The tube preferably contains water as a transfer medium for the shock wave produced by the explosive charges. The water may be retained in the tube by standing the die and tube disposed therein on a rubber mat or the like to provide a seal.

When the hollow spherical article is intended to be used as an outer casing for a ball valve the cylindrical portions are retained and the whole article is split into two halves, either longitudinally or crosswise so that the internal sphere or ball may be inserted.

BRIEF DESCRIPTION OF THE DRAWINGS

The invention will now be described, by way of example only, with reference to the accompanying drawings in which:

FIG. 1 shows one half 1 of a tool steel die having a hemispherical shaped face 2. The second half of the die (not shown) is similar to the first half 1. The die was such that the moulded sphere had a diameter approximately 1½ times the diameter of the bore of a tube 3, shown in FIG. 2, from which the sphere was to be formed. The die was manufactured in accordance with these dimensions.

As shown in FIG. 2 a wrought stainless steel tube was inserted into the die and the two halves were located together by means of location dowels 4 and closure bores 8. The assembly of die and tube 3 was placed on a rubber mat 5 to provide a waterproof seal at the lower openings of the die and tube. Water was poured into the tube to act as the transfer medium for the shock waves to be produced.

Figure 1:
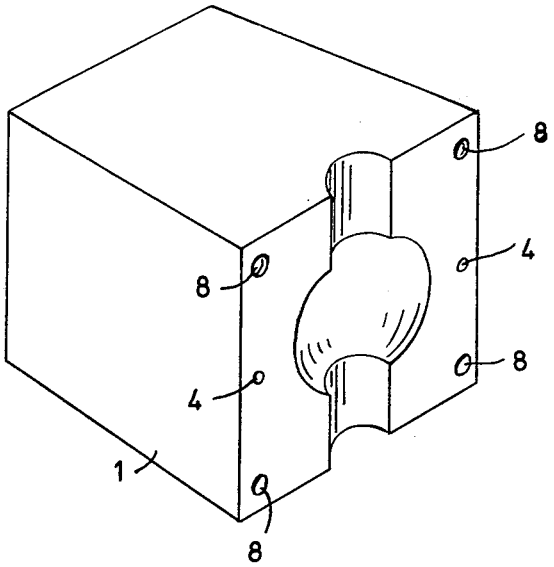
FIG. 1 shows diagrammatically one half of a tool steel die for manufacturing a ball valve sphere.
Figure 2:
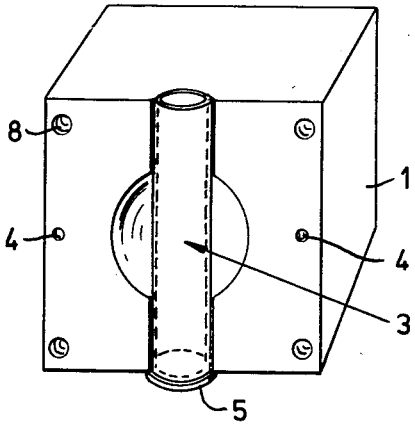
FIG. 2 shows a tube located inside the die of FIG. 1.
Figure 3:
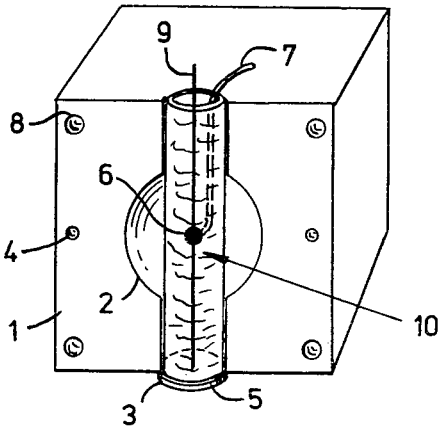
FIG. 3 shows the assembly of tube and die ready for firing.
Figure 4:
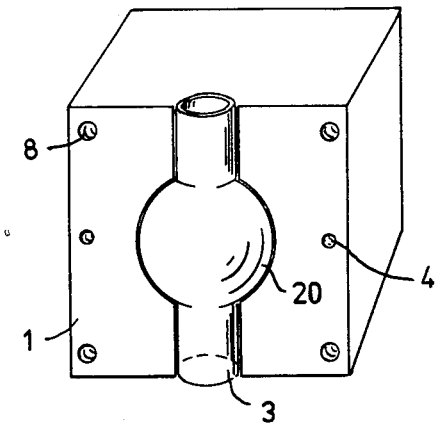
FIG. 4 shows the assembly after one firing step.

A first explosive charge 6 was inserted into the water 10 in tube 3 and suspended by wire 9 approximately at the centre of the sphere formed by the curved surfaces 2 and along the axis of the tube 3 as shown in FIG. 3. Detonator wires 7 led from the explosive charge 6 to suitable detonating equipment (not shown). The explosive charge was fired and the shock wave produced formed the tube as shown in FIG. 4. The shock wave causes the tube to be driven against the face of the die and take up approximately the spherical shape 20.

Successive firings were carried out until the tube has been formed into the required sphere. Not all the explosive charges need to be placed centrally and axially.

Figure 5:
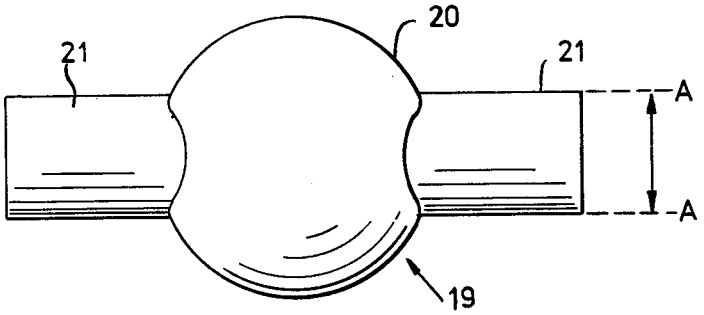
FIG. 5 shows the formed article removed from the die.

FIG. 5 shows the formed article 19 removed from the die, suitable for use as the outer casing of a ball valve. The formed article has a spherical portion 20 and two cylindrical portions 21 attached thereto and derived from the original tube. The diameter A—A of the cylindrical portions 21 is the same as the diameter of the original tube.

Figure 6:
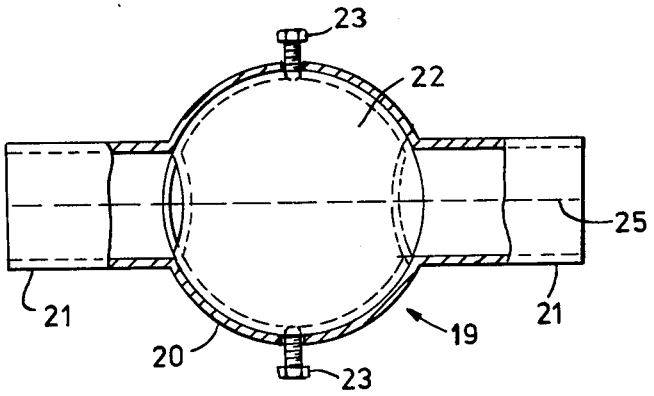
FIG. 6 is a diagram illustrating a ball valve outer casing and an inner sphere located therein.

FIG. 6 shows diagrammatically a completed ball valve having an outer casing 19 as shown in FIG. 5 and split longitudinally along 25 for insertion of an internal sphere 22. The sphere or ball 22 was explosively formed in the same way as the outer casing 19 to appropriate dimensions. The remaining parts of the original tube (not shown) were then removed by machining to leave two apertures in the surface of the sphere 22 opening into the hollow interior. The valve comprising outer casing 19 and internal sphere 22 was then provided with a conventional means 23 for turning the internal sphere 22 in order to regulate flow of material through the valve.

In a particular example of the present invention a ball valve internal sphere was formed from wrought stainless steel tube having an outside diameter of 3.5 inches and a wall thickness of 0.12 inches. The material of the tube was 316 autenistic stainless steel having an elongation factor of 55%.

The explosive system used was a No. 6 Imperial Chemical Industries detonator, with lengths of Superflex detonating cord. Superflex detonating cord contains P.E.T.N. P.E.T.N. is the abbreviated name for PENTAERYTHRITOL TETRANITRATE ($C_5M_8O_{12}N_4$) which detonates at 27,500 ft/sec. The type of explosive used is not critical, but for this application it was desirable to produce high power within a confined space in terms of volume, and Superflex was selected.

The specific energy released by the explosive is $1.93\times10^{-6}$ ft lbs/lbs. maximum pressure at initiation 3.2 million lbs p.s.I.

Five successive charges of No. 6. detonator with 5 inches of Superflex detonating cord were used. The tube was removed from the die after the second firing and was annealed. The tube was replaced in the die for the subsequent firing. The fourth and fifth charges were located off-centre in order to develop fully the sphere apertures.

The completely moulded sphere on inspection had a constant wall thickness of 0.090". Therefore, to expand the 3.50" O.D. tube into a sphere of 5.50" O.D., the wall thinned by some 0.030".

A series of readings across the sphere at indicated markings was taken and tolerance to dia. of 5.50" was within ±0.003".

The cylindrical portions remaining on the formed article were machined off.

The above example was repeated using stainless steel tubes of initial internal diameters 1", 1½", 4" and 8".

For the 8" diameter sphere the series of explosive charges were as follows:

| | | |
|---|---|---|
| 1st charge | 100" | Superflex detonating cord |
| 2nd charge | 100" | Superflex detonating cord |
| 3rd charge | 80" | Superflex detonating cord |
| 4th charge | 60" | Superflex detonating cord |

After the firing of each charge the workpiece was removed from the die and annealed.

For the 4" diameter sphere the series of explosive charges were as follows:

| | | |
|---|---|---|
| 1st charge | 20" | Superflex detonating cord |
| 2nd charge | 16" | Superflex detonating cord |
| 3rd charge | 16" | Superflex detonating cord |
| 4th charge | 12" | Superflex detonating cord |

After the firing of each charge the workpiece was removed from the die and annealed.

The stainless steel tubes were replaced by tubes of titanium, cupranickel, copper and Inconel. The explosive charges were adjusted to compensate for material thickness and elongation factor.

An advantage of the present invention is that the original tube can be selected to have suitable dimensions for easy connections to the pipeline system in which the valve is to be used.

We claim:

1. A method of forming a hollow spherical article having at least two substantially diametrically opposed apertures in the spherical surface, said article being of wrought metal said method comprising placing an open ended tube of wrought metal in a die with the interior of said tube communicating with the exterior of said die, positioning a plurality of explosive charges within the tube and sequentially detonating the explosive charges to act directly on and expand the tube into said hollow spherical article having two cylindrical portions extending generally radially from opposed sides of said article, said cylindrical portions defining said substantially diametrically opposed apertures in said surface.

2. A method according to claim 1 wherein the explosive charges are a series of single charges detonated in a predetermined sequence.

3. A method according to claim 2 wherein after at least one firing of an explosive charge the tube is removed from the die and annealed.

4. A method according to claim 2 wherein the tube is removed from the die and annealed after each firing.

* * * * *